United States Patent [19]

Woodliff

[11] Patent Number: 4,928,967

[45] Date of Patent: May 29, 1990

[54] MAP BOARD GAME

[76] Inventor: Ann S. Woodliff, P.O. Box 9938, Seattle, Wash. 98109

[21] Appl. No.: 419,316

[22] Filed: Oct. 10, 1989

[51] Int. Cl.[5] ..... A63F 3/00; A63F 9/18

[52] U.S. Cl. ..... 273/254; 273/256

[58] Field of Search ..... 273/256, 249–254, 273/243

[56] References Cited

U.S. PATENT DOCUMENTS 3,756,604 9/1973 Laszlo ..... 273/256
4,109,918 8/1978 Mele et al. ..... 273/256

FOREIGN PATENT DOCUMENTS 184517 8/1922 United Kingdom ..... 273/251
2205254 12/1988 United Kingdom ..... 273/254

*Primary Examiner*—Benjamin Layno

[57] ABSTRACT

A board game (FIG. 1) featuring an actual map of the world (5) with an outer border (7) in colors corresponding to the colors of specific regions designated on the world map (i.e. 11 and 26). Players (FIG. 3) move from region to region around the world by electing to go clockwise around the outer border or by choosing a transportation card (FIG. 2) which allows for movement into certain regions. Once in a region a player may purchase the business (FIG. 8) in that region or may accumulate world market currency (FIG. 5) by answering correctly a question (FIG. 4) specific to that region of the world. The winner is the player who owns all the businesses of the world or who acquires the most world market currency after a period of playing specified by the players at the beginning of the game.

8 Claims, 7 Drawing Sheets

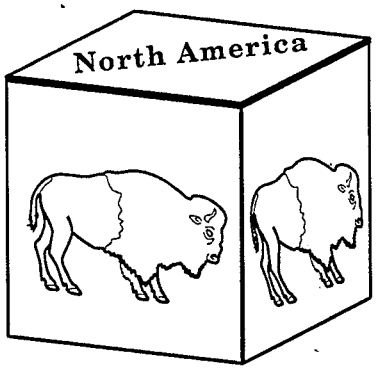
Figure 3
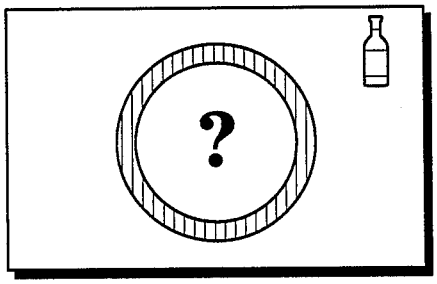
Figure 4a
South America
The Spanish name of the Falkland Islands is
A. Galtieri
B. The Malvinas
C. Isle de Peron
D. Aconcagua
Ans. B
Europe
Queen Margrethe II, the first Queen in Denmark's history, took the throne in
A. 1849
B. 1901
C. 1950
D. 1972
Ans. D
Asia
True or False:
Hong Kong was attacked by Japanese troops on December 7, 1941
Ans. True
Figure 4b

World Market Business Listing

| Region | Businesses | Cost to Buy |
|---|---|---|
| Africa | diamonds | WC 120 |
| | wood | WC 60 |
| Asia | electronics | WC 100 |
| | silk | WC 60 |
| Australia/ New Zealand | wool | WC 90 |
| | beer | WC 80 |
| Europe | wine | WC 100 |
| | leather goods | WC 70 |
| Middle East | carpets | WC 100 |
| | brass | WC 80 |
| North America | precious metals | WC 120 |
| | oranges | WC 40 |
| South America | coffee | WC 40 |
| | bananas | WC 30 |
| U.S.S.R. | vodka | WC 40 |
| | cavier | WC 60 |

Figure 6a

Income Generated from Businesses

| Product | Cost of Gift |
|---|---|
| diamonds | WC 40 |
| wood carvings | WC 20 |
| stereos | WC 40 |
| silk scarves | WC 20 |
| wool sweaters | WC 30 |
| beer | WC 10 |
| wine | WC 30 |
| leather goods | WC 30 |
| carpets | WC 40 |
| brass trays | WC 20 |
| jewelry | WC 40 |
| oranges | WC 10 |
| coffee | WC 20 |
| bananas | WC 10 |
| vodka | WC 10 |
| cavier | WC 20 |

Figure 6b

| Transport Ranking |
|---|
| 1. Plane |
| 2. Helicopter |
| 3. Train |
| 4. Car |
| 5. Cruise Ship |
| 6. Junk |
| 7. Camel |
| 8. Donkey |
| 9. By Foot |

Figure 7b

| Transport Listing | |
|---|---|
| Mode | Destination |
| Plane | Anywhere, except Middle East |
| Helicopter | Middle East, Africa |
| Train | Europe, U.S.S.R., South America |
| Car | Anywhere |
| Cruise Ship | North America, Europe, Australia/New Zealand |
| Junk | Asia |
| Camel | Africa, Middle East |
| Donkey | South America |
| By Foot | Africa, Asia, South America |

Figure 7a

| | |
|---|---|
| Vineyard | WC 100 |
| Wine | WC 30 |

MAP BOARD GAME

TECHNICAL AREA

The present invention relates to games and, more particularly, board games. My map board game calls upon a player's understanding of world affairs and history, as well as a skill in acquisition of world markets represented by businesses and industries located in different regions of the world.

BACKGROUND OF THE INVENTION

There are a number of board games available that are widely used by people for entertainment and education, but none of them provides a game that meets certain objectives, which are the objectives of the invention disclosed herein.

A number of U.S. Pat. Nos. 983,925; 2,347,094; 3,711,966; 3,947,038; and 4,078,803 have used a geographical board game, but these aforementioned board games are non-applicable to my present invention.

The present invention provides an actual map of the world, which serves as an educational and interesting playing field for complex game of world market acquisition which requires a player's acumen in strategy and knowledge of different cultures.

The present invention provides a series of non-fictional question and answer cards for each of the eight world regions. Such cards test the player's knowledge of the various world regions and relate generally to cultural and historical awareness of each region. In order to purchase a business within a particular world region, a player must correctly answer the question dealing with that region.

The present invention also provides a means of moving from one region of the world to another through selection of transportation cards which designate alternative modes of travel allowing access to certain regions and not other regions, thereby providing an element of chance (the random selection of the transportation cards) and choice (a decision as to which of several designated regions to visit).

SUMMARY OF THE INVENTION

In accordance with this invention, a playing board having an actual map of the world printed thereon, with an outer border having color segments relating to the colored regions of the world is provided. A player may choose movement around the board clockwise at the player's turn or by selection of a transportation card (3). Once in a region, a player may choose to acquire world market currency only or to acquire one of the two businesses in that region, either of which choices requires the correct answering of a question specific to that region. An attempt to acquire a business also requires the giving of a gift. The gift is designated on the question card and generates income for the player, if any, which owns the business producing such gift. Gifts come from one of the sixteen world markets, for example a bottle of wine from the European wine business. The players are challenged by questions testing their international expertise, by decisions as to acquisitions of world markets and by a plurality of chance happenings represented in the draw of both the transportation cards and the question and answer cards which all combine to create a game substantially true to life.

As will be readily appreciated from the foregoing description, the invention provides a board game featuring an actual map of the world. Because of the authenticity of the playing board, it provides a stimulating board for the players. Preferably the board is formed of a relatively thick cardboard with the border colors of the board matching the colors of the various corresponding world regions. A player's movement from one region to another and acquisition of various businesses are predicated upon a player's luck and strategy. Further, because the questions presented to the players are non-fictional, playing the game is educational, as well as entertaining.

BRIEF DESCRIPTION OF THE DRAWINGS

The objects and features of the invention may be understood with reference to the following detailed description of an illustrative embodiment of the invention, taken together with the accompanying drawings on which:

FIG. 3 illustrates one example of the playing pieces.

FIGS. 4A and 4B, respectively, illustrate the front and rear of sample question cards.

FIGS. 6A and 6B, respectively, illustrate both sides of the world market business listing.

FIGS. 7A and 7B, respectively, illustrate both sides of the transport listing.

DESCRIPTION OF THE PREFERRED EMBODIMENT

Figure 5A:
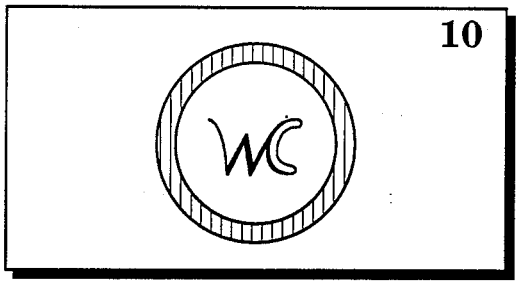
FIGS. 5A and 5B, respectively, illustrate both sides of one denomination of world market currency.
Figure 5B:
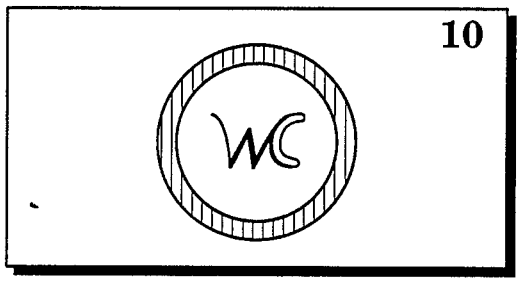
Figures 8A, 8B:
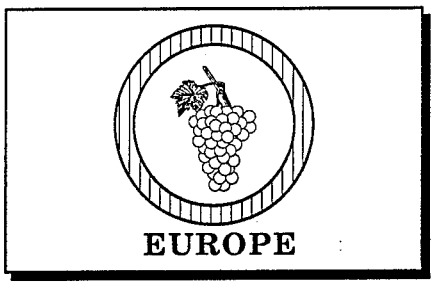
FIGS. 8A and 8B, respectively, illustrate both sides of a sample business certificate.

This invention is a world market game application comprising a board (FIG. 1); transportation cards (FIGS. 2A and 2B); a plurality of playing pieces (FIG. 3); question cards (FIGS. 4A and 4B); world market currency (FIGS. 5A and 5B); world market business listing (FIGS. 6A and 6B); transport listing (FIGS. 7A and 7B); and business certificates (FIGS. 8A and 8B). An alternative to having world market currency is to have a counter.

The board includes a map of the world 5 surrounded by colored areas 12, 14, 16, 18, 20, 22, 24, and 26 to identify major regions of the world. Each of the transportation cards includes a front and a back. The front contains a red circle in which is a picture of a suitcase with a T on it; the back contains different drawings on each card, such as an airplane, helicopter, train, cruise ship, junk, donkey, camel or car. Each of the player's blocks is a cube that contains certain information on each surface such as the name of the region corresponding to the region listed on the playing board and a drawing of an animal indigenous of such region (i.e. llama for South America, buffalo for North America, brahma for Asia, camel for Middle East, elephant for Africa, huskie for U.S.S.R., kangaroo for Australia/New Zealand and donkey for Europe). Each of the question cards includes a front and a back. The front contains a red circle in which a picture of a question mark is enclosed and also contains in the upper right hand corner a picture of a product corresponding to the products produced by the various world businesses (i.e. a wine bottle representing a European business; bananas representing a South American business, etc.). The back of the question card contains different multiple choice questions relating to factual questions of the various regions. Each of the world market currency cards contains a back and a front which is identical, showing a red circle in which a symbol for the world market currency is contained. The upper right hand corner on both the front and the back of the world market currency card contains various denominations of the currency (i.e. 10, 20, 30, 40, 50). The world market business listing includes a front and a back. The front lists the various regions of the world, the two businesses in each region and the cost to buy such businesses. The back lists the products produced by the same businesses listed on the front side and the cost to buy such products for gift giving purposes. The transport listing includes a front and a back side. The front lists the various modes of transportation (i.e. plane, train, etc.) and the allowed destinations for such modes of transportation. The back lists the transport ranking of each mode of transportation. The business certificates include a front and back. The front contains a red circle in which is a picture relating to that region's business (i.e. a grape vine for the European wine business) and the name of the region at the bottom. The back lists the business, the amount in world market currency to buy such business, the product from such business and the amount in world market currency to purchase a product from such business.

Figure 1:
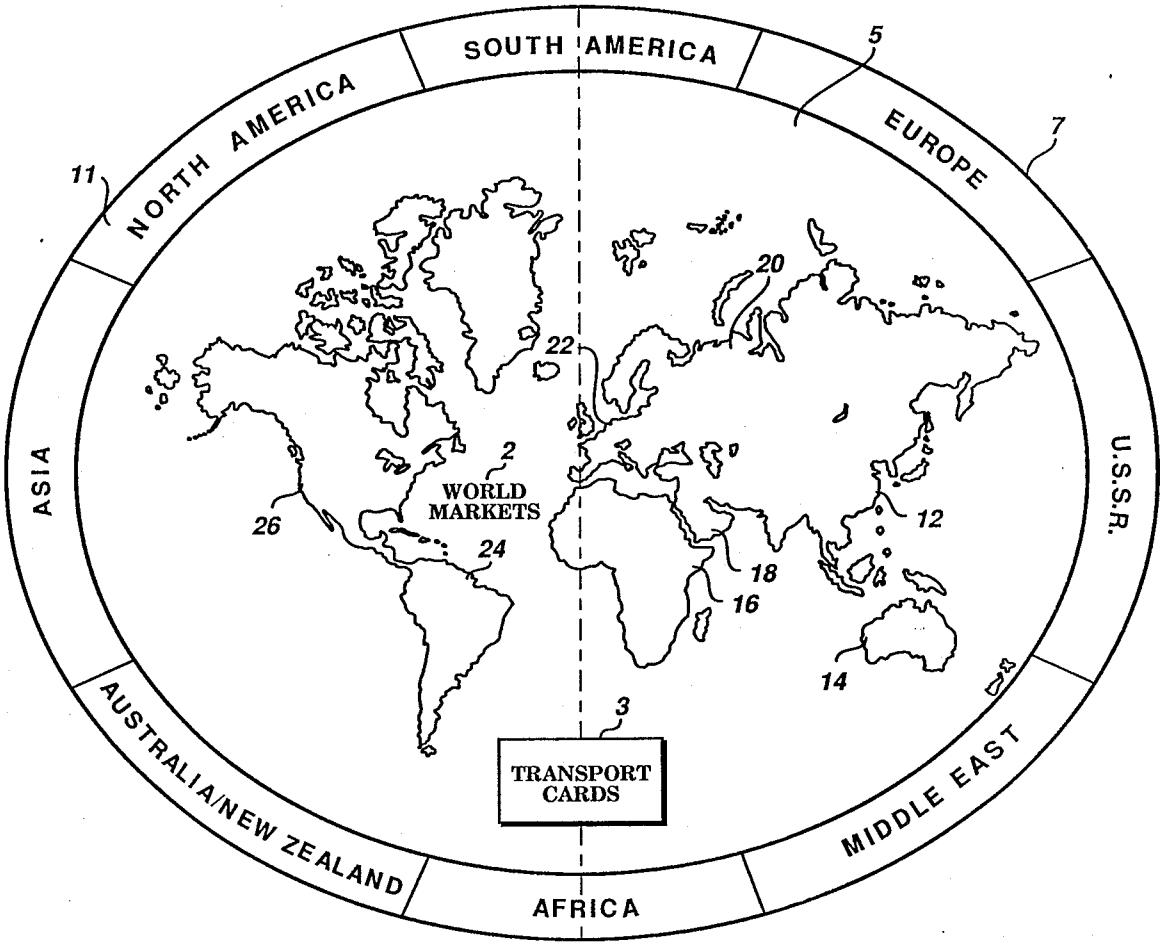
FIG. 1 illustrates a game board suitable for use in the presently preferred embodiment of the invention.
Figure 2A:
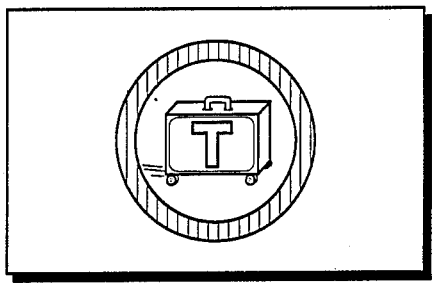
FIGS. 2A and 2B, respectively, illustrate the front and rear of transportation cards.
Figure 2B:
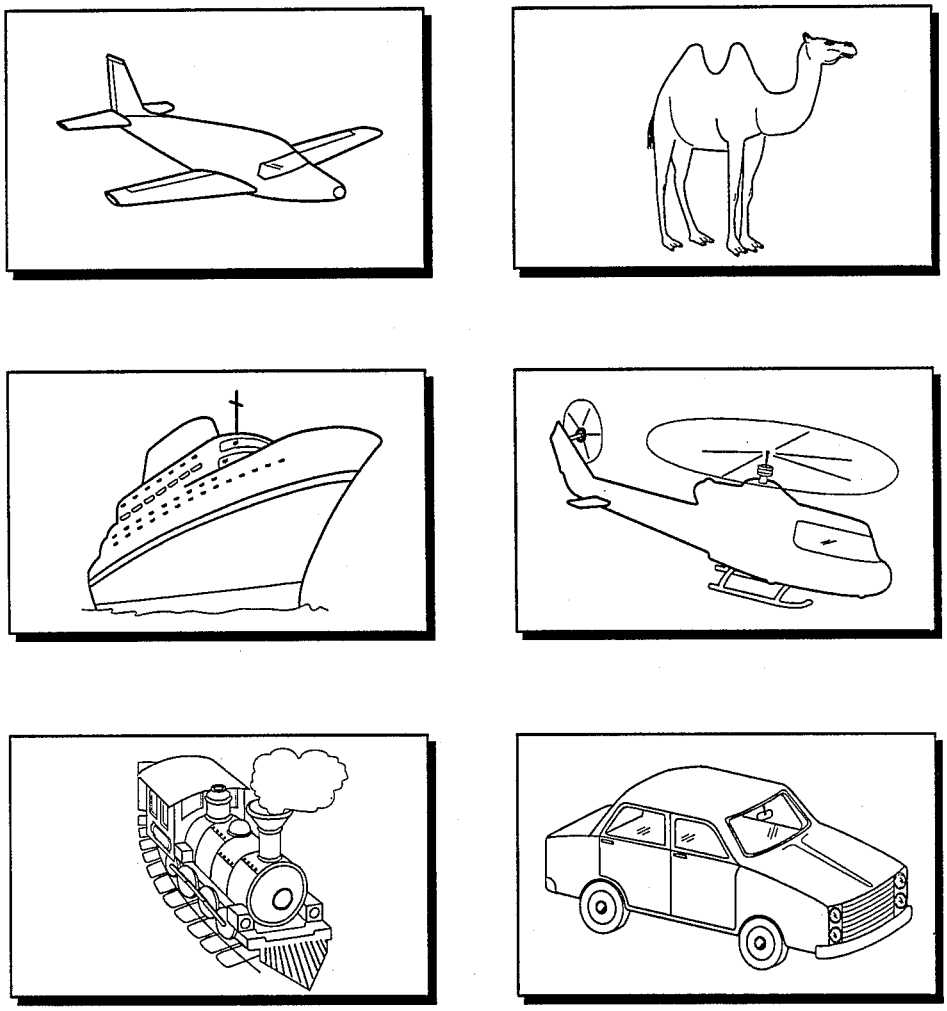

Accordingly, with reference to FIG. 1, a game board made of board, plastic or thick paper is shown with an actual, not stylized map of the world 5 with eight separate colored regions and a border 7 divided into eight colored areas corresponding to the colored regions of the map (i.e. 11 and 26). Inasmuch as the game is known as World Markets, that name is indicated at 2 on the board in the central space, whereon at 3 is indicated the place where the set of transportation cards are piled, preferably face down.

With reference to FIG. 3, the game board contains eight colored playing pieces, each colored piece corresponding to the colored regions of the map and the colored border areas around the map. Once having chosen a playing piece, the player places that colored piece on the corresponding colored area on the border of the game board.

Two to eight persons may play this game. Each player starts with no world market currency (WMC). A player may go to a certain designated negative WMC before being bankrupt. Once bankrupt a player has a Last Financing Chance, as described below, which will allow the player to continue play or dictate the player's removal from the game.

The game play is initiated by each player's draw of a transportation card from the transportation deck. The transportation listing, indicated by FIG. 7B, designates the order of significance of each transportation card, and FIG. 7A designates the region of the countries which may be visited using the specific mode of transportation designated on each card.

The order of significance, for example, a plane as number one and a helicopter as number two, establishes who will go first. The highest numbered item drawn would beat any other mode of transportation under it and would allow the player choosing such card to go first. For example, player one's draw of a plane transportation card would beat player two's draw of a helicopter transportation card. Should two players draw the same mode of transportation, then they both draw again until they have different cards. The player holding the highest mode of transportation starts the game by choosing either to move clockwise from his/her country region or to use the transportation card drawn to initiate the play of the game. The player on the board clockwise to the beginning player will go next and so on. Each player has the option of moving clockwise on the board's border one region at a turn or taking a transportation card and choosing any region allowed to be visited by such mode of transportation. (See Transport Listing for region and transportation designations.) The player may not stay in that player's region for his/her first turn.

The path or course made up of eight colored spaces on the playing board's border extends around the board and corresponds with the colored regions of the world on the map in the center of the board. The players move their pieces from one area of the border to another, either on a clockwise fashion or randomly by the draw of transportation cards. The board's border serves as a place for each player's piece to rest while in play, but does not act as a course with a termination point.

Each region has two businesses, which may be acquired for purposes of generating WMC. Products from the various regional industries appear randomly on the question cards, thereby generating income to the player which holds the business producing such products For example, the player owning the wine business of Europe would receive WMC each time a wine bottle appeared as the designated gift on a question card of the player drawing such card who was attempting to buy that region's business. When a question card is drawn, a player has the option of buying either one of the regional businesses (if such businesses are still available) or buying neither business and simply collecting WMC by answering the question correctly. If another player who already owns that region's business in that region at the time the player lands in the region, then the player may negotiate with the present owner to buy the business at a certain WMC price (the negotiation process is described below). Each question card designates the gift necessary to present to acquire the region's business and a question with multiple choice listing of answers.

Upon landing in a region where businesses are still available for purchase, the player states whether he or she intends to purchase one of the region's businesses. If the player intends to do so, then the player must purchase a gift as designated on the question card. If another player owns the business/industry producing that product then the player receives the WMC from the player attempting to purchase a business. If no other player owns such business, then the WMC for such gift goes into the World Bank. After paying for such a gift, the player is ready to do business in that region. In order to be eligible to purchase one of the region's businesses the player must answer correctly the question read by another player from that region's question card. After answering the question correctly, the player may choose which business he or she desires to purchase, pay the World Bank the WMC to purchase such business as designated on the World Market Listing (FIG. 6) and receive the business certificate (FIG. 8). The cost of such business and the income produced from the product of the business is designated on the World Market Business Listing. The business certificates held by the players should be left face up in front of the players. If one player lands in a region which another player is, and if that other player owns either of the two regional businesses, then the player landing in such region may negotiate a WMC price for the cost of either of the two businesses. The price must be set before the player desiring to buy the business is asked the question for that region. This player must still answer the question correctly in order to purchase the business from the owner. However, the player does not have to purchase the designated gift. If the player fails to answer the question correctly, no WMC exchanges hands and the next player takes his or her turn.

If a player reaches the designated negative WMC indicating that player's bankruptcy, then the player has a last chance to receive financing from the World Bank (The Last Financing Chance). In order to do so, the bankrupt player must answer three of four questions asked the player. The player may choose one card only from any four of the eight world regions. The player has no opportunity to buy businesses in the region, nor does the player have to pay for the gift designated on the question card. If the player answers three of the four questions correctly, the player receives all the WMC in the World Bank. If not, the player is out of the game.

At the outset of the game the players decide the WMC amount one player must obtain in order to win, or the number of hours the game will be played. If no such designation is made, the player who attains ownership of all the businesses of the world is the winner.

Although the invention has been described with reference to a particular embodiment thereof, it should be realized that various changes and modifications may be made therein without departing from the spirit and scope of the invention, and it is indicated that all matter contained herein is intended as illustrative and not as limiting in scope.

The embodiments of the invention in which an exclusive property or privilege is claimed are defined as follows:

1. A board game comprised of:

a board having a map of the world surrounded by a playing path divided into sections that identify major regions of the world; a plurality of world businesses, each major region representing at least one of said businesses a plurality of transportation cards, each of said transportation cards indicating various modes of transportation and indicating the sections which said player blocks are allowed to be moved to; a plurality of player blocks; a plurality of question cards corresponding to each of said major regions, each question card comprises a question relating to one of said major regions and indicia thereon depicting a business of said major region; world market currency in various denominations; a world market business listing; a transport listing; and business certificates corresponding to each of said plurality of world businesses, wherein each business certificate comprising said indicia depicting a business, and a monetary value indicating the cost to buy said business.

2. A board game as recited in claim 1, wherein the board game includes a border of separate colors which correspond to the region on the board of the same color, such border constituting a path extending around the board, said path providing a continuous track for the purpose of continuity of play.

3. A board game as recited in claim 1, wherein said question on each card being a factual multiple choice question.

4. A board game as recited in claim 1, wherein said indicia depicts pictures of products from the various world region businesses.

5. A board game as recited in claim 1, wherein said set of transportation cards designating modes of transportation such as airplane, helicopter, train, cruise ship, junk, donkey, camel and car.

6. A board game as recited in claim 1, wherein said game including a designation of the world region corresponding to the map designations of said world regions and drawings of animals indigenous to said regions, to be moved by players in accordance with the draw of a transportation card or a decision by the player to move clockwise around the board's border.

7. A board game as recited in claim 1, wherein said world market business listing having indicia designating the regions of the world, the businesses associated with each region, the cost to buy such businesses, the products produced by such businesses and the cost to buy such products.

8. A board game as recited in claim 1, wherein said transport listing having indicia designating the priority of each mode of transport and the destination allowed by each mode of transport.

* * * * *